US008162291B2

(12) United States Patent
Graner et al.

(10) Patent No.: US 8,162,291 B2
(45) Date of Patent: Apr. 24, 2012

(54) WINCH

(75) Inventors: Klaus Graner, Uttenweiler-Ahlen (DE); Oliver Fenker, Attenweiler (DE); Johann Lis, Riedlingen (DE); Thomas Muenst, Fischbach (DE)

(73) Assignee: Liebherr-Components Biberach GmbH, Biberach/Riss (DE)

( * ) Notice: Subject to any disclaimer, the term of this patent is extended or adjusted under 35 U.S.C. 154(b) by 221 days.

(21) Appl. No.: 12/385,540

(22) Filed: Apr. 10, 2009

(65) Prior Publication Data

US 2009/0256125 A1 Oct. 15, 2009

(30) Foreign Application Priority Data

Apr. 10, 2008 (DE) ..... 20 2008 004 985 U

(51) Int. Cl.
*B66D 1/26* (2006.01)

(52) U.S. Cl. ..... 254/278; 254/361

(58) Field of Classification Search ..... 254/278, 254/360, 361

See application file for complete search history.

(56) References Cited

U.S. PATENT DOCUMENTS

| | | | | | |
|---|---|---|---|---|---|
| 1,323,245 | A * | 12/1919 | Borkes | 254/344 |
| 2,066,779 | A * | 1/1937 | Himmel | 475/149 |
| 2,354,387 | A * | 7/1944 | Lawler | 254/342 |
| 2,540,099 | A * | 2/1951 | Christian | 74/421 A |
| 3,648,814 | A * | 3/1972 | Barron | 192/113.31 |
| 4,096,404 | A * | 6/1978 | Sukhanov et al. | 310/67 R |
| 4,310,146 | A * | 1/1982 | F'Geppert | 254/342 |
| 4,760,971 | A * | 8/1988 | Hodgetts | 254/342 |
| 4,860,965 | A * | 8/1989 | Hodgetts | 254/342 |
| 6,113,023 | A * | 9/2000 | Ueffing et al. | 242/388.6 |
| 6,619,625 | B2 * | 9/2003 | Kiviniitty | 254/342 |
| 7,451,963 | B2 * | 11/2008 | Finkenbusch et al. | 254/278 |
| 7,780,147 | B2 * | 8/2010 | Franks | 254/378 |

FOREIGN PATENT DOCUMENTS

| | | |
|---|---|---|
| DE | 1911195 U | 3/1965 |
| DE | 197 33 299 A1 | 2/1999 |
| DE | 197 52 003 C2 | 10/1999 |
| EP | 0 919 512 A2 | 10/1999 |
| GB | 1 213 531 | 11/1970 |

* cited by examiner

*Primary Examiner* — Emmanuel M Marcelo
(74) *Attorney, Agent, or Firm* — Jacobson Holman PLLC

(57) ABSTRACT

A winch for elevating at a plant, in particular for cranes, cable-operated excavators, and similar construction machinery, has a hoisting drum, an electric motor for the drive of the hoisting drum which is received in the interior of the hoisting drum, and power electronics and/or control electronics for the electric motor including at least one frequency inverter and/or frequency converter. The power electronics and/or control electronics for the electric motor are received at least partly in the interior of the hoisting drum. With the compact construction of the winch, short cabling distances are achieved, interference emissions having negative effects on electromagnetic compatibility are avoided, and voltage overshoots impairing the service life of the inverter and the motor are reduced.

24 Claims, 5 Drawing Sheets

WINCH

BACKGROUND OF THE INVENTION

1. Field on Invention

The present invention relates to a winch for elevating at a plant, in particular for cranes, cable-operated excavators, and similar construction machinery, comprising a hoisting drum, an electric motor for the drive of the hoisting drum which is received in the interior of the hoisting drum as well as power and/or control electronics for the electric motor comprising at least one frequency inverter and/or frequency converter.

2. Description of the Prior Art

Hoisting winches driven by electric motors are generally known in which the transmission and the motor are arranged outside the winch drum. There are equally hoisting winches in which a planetary transmission is positioned inside the winch drum via which the winch drum is driven by an outwardly positioned motor, cf. DE 19 11 195 U1. Hoisting winches are furthermore known in which in addition to the integrated planetary transmission the electric motor is likewise located inside the hoisting winch drum, cf. DE 197 52 003 C2, which also wants to achieve a compact construction for winches for high load demands in that an asynchronous motor is used with a positively actuated liquid cooling which covers both the stator and the rotor serially. The control electronics for the electric motor are in this respect received in a switch cabinet which is integrated into the winch support and fits snugly between two hoisting drums journaled at the winch support.

The control of the described drive motors centrally from a switch cabinet, however, requires long electric cables. The cabling effort in this respect, in particular from the inverter to the motor, is substantial. Interference emissions arise due to long lines which have a negative effect with respect to the electromagnetic compatibility. Long motor feed lines can equally result in reflections and thereby to voltage overshoots which can substantially restrict the service life of the frequency inverter and motor.

Alternatively to this, attempts have already been made to use inverters integrated in the motor with non-installed electric motors arranged outside the hoisting drum. The latter is, however, restricted to comparatively small powers.

SUMMARY OF THE INVENTION

Starting from this, it is the underlying object of the present invention to provide an improved winch of the initially named type which avoids disadvantages of the prior art and further develops the latter in an advantageous manner. A powerful continuously speed-variable electric drive for a hoisting winch should in particular be provided which has a space-saving construction, has no negative effects on the electromagnetic compatibility and avoids the voltage overshoots which shorten the service life.

This object is solved in accordance with the invention by a winch as described herein. Preferred embodiments of the invention are also described herein.

It is therefore proposed, beside the electric motor, also to integrate at least the major components of the power and/or control electronics for the electric motor into the hoisting drum to avoid long cabling distances. In accordance with the invention, the power and/or control electronics for the electric motor are received at least partly in the interior of the hoisting drum. Not only short cabling distances are hereby achieved; interference emissions with negative effects on the electromagnetic compatibility are avoided; and voltage overshoots impairing the service life of the inverter and the motor are reduced, but also a particularly compact construction of the winch is achieved.

To avoid thermal problems in the arrangement of the power and/or the control electronics in the drum interior, the power and/or control electronics are cooled by means of an electronics cooling device in a further development of the invention. The cooling of the electronic components received in the interior of the hoisting drum in this respect takes place by means of a liquid cooling which can lead off the lost heat arising in the electronic components in a highly efficient manner. At the same time, a compact construction of the electronics can be achieved by the liquid cooling thereof which in turn simplifies the integration of the electronics into the hoisting drum.

In a further development of the invention, the frequency inverter and/or frequency converter or pulse-controlled inverter is in particular arranged at the interior of the hoisting drum and is liquid cooled. In this respect, the frequency inverter is advantageously substantially fully received in the interior of the hoisting drum, with optionally a junction plate or a terminal box of the frequency inverter being able to project out of the drum to be able to achieve a simple connection of the cabling. Apart from the junction plate or terminal box which can likewise be arranged in the interior of the hoisting drum in accordance with an advantageous embodiment of the invention, in particular the intermediate circuit capacitors, the control part as well as the power modules are arranged as the heart of the inverter inside the hoisting drum in a further development of the invention. In this respect, in particular the power transistors are liquid cooled via the liquid cooling circuit of the electronics cooling device to lead off the arising lost heat efficiently. The cooling liquid is in this respect advantageously circulated in a compulsory manner to achieve a sufficient heat dissipation.

The liquid cooling circuit for the frequency inverter can in this respect include a cooling jacket and/or cooling pipe coils which are arranged at the inverter and/or are areally in contact with its electronic components.

The liquid cooling can in this respect generally work with different cooling liquids, for example an oil cooling could be provided. In a preferred further development of the invention, however, the liquid cooling circuit for the cooling of the frequency inverter comprises a cooling liquid on a water base, in particular a water-glycol mixture or, optionally, also pure water. Such a water cooling has a very high thermal capacity, whereby an effective cooling capacity can be achieved with moderate throughflow quantities. In addition, small temperature differences result between the forward circulation and the return circulation due to the high thermal capacity. This has the result that in a serial circuit the last-cooled component finds a still permissible temperature level.

In an advantageous further development of the invention, not only the power and/or control electronics disposed in the hoisting winch are liquid cooled, but also the electric motor. For this purpose, a motor cooling device can have at least one liquid cooling circuit for the cooling of the electric motor which can include a jacket cooling and/or cooling pipe coils, with in a preferred further development of the invention also a mixture of air cooling and liquid cooling being able to be provided for the electric motor. In accordance with a particularly advantageous embodiment of the invention, provision can be made that the liquid cooling for the electric motor includes, in addition to a cooling jacket for the stator winding, cooling coils in the end winding spaces in which an internal air circulation, i.e. an air circulation working without external ambient air, is generated by means of fan wheels and sweeps through and/or around the end windings and optionally also through the rotor, with the cooling air emitting the heat taken up to the liquid circuit via the named cooling pipe coils. Depending on the design of the electric motor, however, other motoring cooling devices can also be used. Instead of a customary asynchronous motor, for example, a permanent magnet excited synchronous motor can be used which can also be cooled sufficiently by a liquid cooling, for example in the form of a jacket cooling alone, due to the losses largely arising in the stator due to the principle involved and to the highly efficient construction. However, other kinds of electric motors can also be used with different principles of action; for example in a further development of the invention, an asynchronous motor, a transfer flow machine or a switched reluctance motor or also mixed forms thereof.

In an advantageous further development of the invention, the drive of the hoisting drum by the electric motor takes place via an interposed transmission which is advantageously likewise received in the interior of the hoisting drum. In this respect, in particular a planetary transmission can be provided in a further development of the invention which can preferably be made in multiple stages. To eliminate lost heat which occurs in the region of the transmission and to hereby avoid thermal problems in the drum interior, in a further development of the invention a transmission cooling device can be associated with the transmission arranged in the drum interior, said transmission cooling device likewise comprising a liquid cooling circuit in an advantageous embodiment of the invention. Due to the liquid cooling of the interposed transmission, its lost heat can be efficiently drawn out of the drum interior.

The liquid cooling circuits of the electronics cooling device, of the motor cooling device and/or of the transmission cooling device can generally be linked to one another, with the liquid cooling circuits being able to be connected to one another in series in a further development of the invention, with a common pump being able to be provided for the circulation of the coolant. A particularly simple embodiment of the cooling device with a small size is hereby achieved.

To be able to adapt the cooling better to the different permissible temperature levels and to the different thermal time constants, provision can also be made in an advantageous further development of the invention that at least one of the liquid cooling circuits of the electronics cooling device, the motor cooling device and the transmission cooling device is made decoupled and/or separately from the remaining liquid cooling circuits. The liquid cooling circuit of the electronics cooling device can in particular be made separately from the liquid cooling circuit of the motor cooling device and of the transmission cooling device, with the separate design of the electronics cooling circuit including at least one separate pump to be able to circulate the cooling liquid for the electronics cooling separately. Alternatively or additionally, other flow control means can also be provided to be able to individually control the coolant flow in the different liquid cooling circuits, for example in the form of a control valve, of a switch valve or of another valve device, by means of which the cooling liquid flow optionally coming from only one pump can be split differently. In this respect, work can advantageously also be carried out with a pump variable with respect to the conveyed flow in order to be able to provide different volume flows depending on the requirements.

With a completely separate design of the liquid cooling circuits, it is optionally also possible to work with different cooling liquids in different liquid cooling circuits to run different thermal capacities. Alternatively, however, it is also possible to work with the same cooling fluid in the different cooling circuits, with it also advantageously being possible to provide a common tank from which the coolant is obtained and into which it is conveyed back.

In a further development of the invention, each cooling circuit can have its own cooler. Alternatively to this, a common cooler can also be used for at least two of the cooling circuits.

In accordance with an advantageous embodiment of the invention, it is also possible to work with a mixed form of partly combined cooling circuits and partly separate cooling circuits. The cooling circuit of the motor cooling and the cooling circuit of the transmission cooling can, for example, advantageously be combined, with advantageously a parallel circuit with a flow control means arranged therebetween being provided to influence the division of the fluid flow between the two parallel arms. On the other hand, the cooling circuit for the electronics cooling is made separately, in particular such that the electronics cooling circuit has a separate pump which can be driven independently of the pump of the cooling circuit for the motor and for the transmission. Where necessary, the two cooling circuits can be guided via a common cooler, with an individual operation of the electronics nevertheless being possible by the separate pump. An individual adaptation of the cooling capacity to the temperature level and to the thermal time constant is possible by such a partial combination of the cooling circuits, on the one hand, whereas a still simple design takes place, on the other hand, with a synergetic utilization of the components.

In a further development of the invention, the frequency inverter is integrated into the hoisting drum such that the unit or components thereof can be replaced on servicing. In accordance with an advantageous embodiment of the invention, the hoisting drum can have an access opening at the end face through which the frequency inverter is accessible and replaceable. A replacement of the frequency inverter or components thereof is advantageously possible with an installed winch.

In a preferred further development of the invention, the frequency inverter or the power and/or control electronics integrated into the hoisting drum includes a releasable electrical connection for the feed lines. The electrical connection of the power and/or control electronics can advantageously be made screwable and/or can be equipped with a junction plate. A plug connection which would have the further advantage that wiring errors are precluded is also conceivable for moderate powers.

In a further development of the invention, the frequency inverter can be installed at the end face at the electric motor. Alternatively to this, the frequency inverter can in a preferred further development of the invention also be arranged spaced apart from the motor at the end face end of the inner space of the hoisting drum, with provision advantageously being able to be made that the electrical connection and/or a terminal box project(s) out of the inner space of the hoisting drum and/or is/are arranged on the end face of the hoisting drum. Provision is in any case advantageously made that the motor feed lines are made so short that emitted electromagnetic radiation is reduced to a minimum. The voltage overshoot at the motor connections is likewise minimized due to the minimal line length. The service life of the winding insulation is optimized. In addition, the cabling effort is very small.

The electrical supply to the inverter can generally be made in different ways. Depending on the inverter type, a two-core line for the intermediate circuit voltage or a line for an AC voltage with any desired phase number can be guided to the inverter which, for example, can be made without an integrated rectifier or also with an integrated rectifier which can in turn be made in uncontrolled or controlled form. The named connection lines can generally be made without screening with screened connection lines advantageously being provided with an integrated controlled rectifier.

If an uncontrolled rectifier is used, no feed of a return capacity in the supply network is provided. In this case, a connection for a return capacity resistor can advantageously be provided.

In a further development of the invention, a speed sensor and/or a rotary encoder can be provided which can be positioned at the end face at an outer side of the hoisting drum. In an alternative further development of the invention, the named speed sensor and/or rotary encoder can likewise be integrated into the inner space of the hoisting drum. If an arrangement of the frequency inverter spaced apart from the motor is provided in the previously named manner, the named speed sensor and/or rotary encoder can advantageously be arranged between the motor and the frequency inverter in the inner space of the hoisting drum, can in particular be seated on the drive shaft of the motor. The cabling effort for the sensor is hereby also minimized. In addition, the sensor is protected from large mechanical shock loads and stray magnetic fields of a magnetic brake.

To allow a simple adaptation of the power requirement of the winch and of the drive components of motor and inverter to one another, the frequency inverter can advantageously have a modular construction. In a further development of the invention, the frequency inverter can comprise a plurality of partial inverters which are each associated with a winding part of the electric motor. A corresponding winding part can in particular be provided for each partial inverter in the motor, whereby the motor winding can be connected more simply and can be designed in a more space-saving manner. The separate modules of the frequency inverter can advantageously be dismantled separately.

BRIEF DESCRIPTION OF THE DRAWINGS

The invention will be explained in more detail in the following with respect to preferred embodiments and to associated drawings. There are shown in the drawings.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
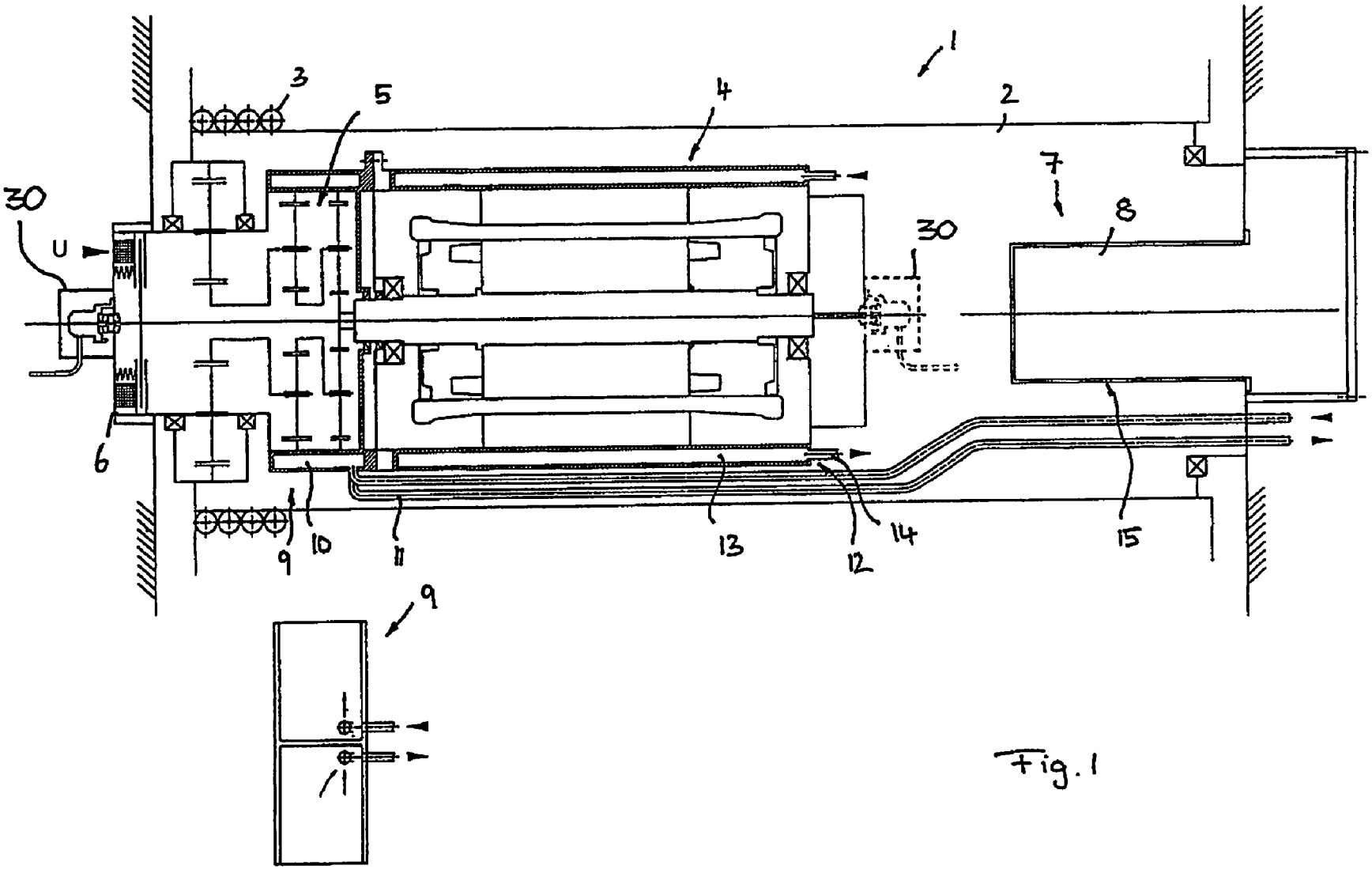
FIG. 1: a schematic longitudinal sectional view of a hoisting winch in accordance with an advantageous embodiment of the invention in which the frequency inverter of the power and/or control electronics is integrated into the interior of the hoisting drum and can be cooled by a liquid cooling.

The hoisting winch 1 shown in FIG. 1 can advantageously be used in elevating plant machinery such as tower cranes, mobile cranes, harbor transfer cranes, or similar construction machinery. The hoisting winch 1 comprises a rotatably journaled hoisting drum 2 onto which a hoist rope 3 can be wound in a known manner. An electric motor 4 arranged in the interior of the hoisting drum 2 drives the hoisting drum 2 via a planetary transmission 5 which is likewise arranged in the interior of the hoisting drum 2 and which can advantageously be made in two stages in accordance with the drawn embodiment. A brake 6 is provided at the one end face of the hoisting drum 2.

The named electric motor 4 is controlled via power and/or control electronics 7 which are likewise arranged in the inner space of the hoisting drum 2 in a manner described even more closely, cf. FIG. 1. The named electric motor 4 is in this respect suited to be operated continuously speed variably at a frequency inverter 8 or pulse-controlled inverter to be able to operate the hoisting winch 1 continuously speed variably. The named electric motor 4 can in this respect be made as an asynchronous motor, but advantageously also as a permanent magnet excited synchronous motor whose losses arising largely in the stator can be led off thermally very well by means of a jacket cooling. However, other electric motor types such as a transverse flow machine, a switched reluctance engine or mixed forms thereof can generally also be provided.

As FIG. 1 shows, both the transmission 5 and the electric motor 4 are liquid cooled, with a transmission cooling device 9 having a cooling jacket 10 which is integrated into the transmission housing and through which a suitable coolant is circulated by means of a transmission cooling circuit 11. The motor cooling device 12 also comprises a jacket cooling having a cooling jacket 13 which is integrated into the motor housing and which is connected to a motor cooling circuit 14 in the embodiment drawn.

To be able to lead off thermal losses in the region of the power and/or control electronics 7, in particular of the frequency inverter 8, despite their integration into the drum inner space, the electronics, in particular the frequency inverter 8, are also liquid cooled. The electronics cooling device 15 includes cooling pipe coils not shown in more detail and guided along the inverter components and/or a cooling jacket which is integrated into an inverter housing and/or into an installation plate for the inverter components. Suitable coolant is circulated in an electronics cooling circuit 16. Water or a mixture on a water basis, in particular a water-glycol mixture, can advantageously be used which has a very high thermal capacity. The coolant circulated in the named cooling circuits is advantageously not used for the lubrication of the transmission or of the motor shaft.

The named cooling circuits can in this respect generally be connected to one another in different manners or also not be connected. The three cooling circuits can, for example, be combined with one another, in particular connected sequentially in series, so that the circulation can be achieved by means of only one coolant conveying means. To be able to achieve an individual control of the coolant flow for the individual components, the cooling circuits can also be connected to one another in parallel, with suitable flow control means being provided to be able to adapt the fluid flow individually. Said means can, for example, be different line diameters, but in particular also control valves and/or switch valves at the branching points of the parallel circuit.

Figure 3:
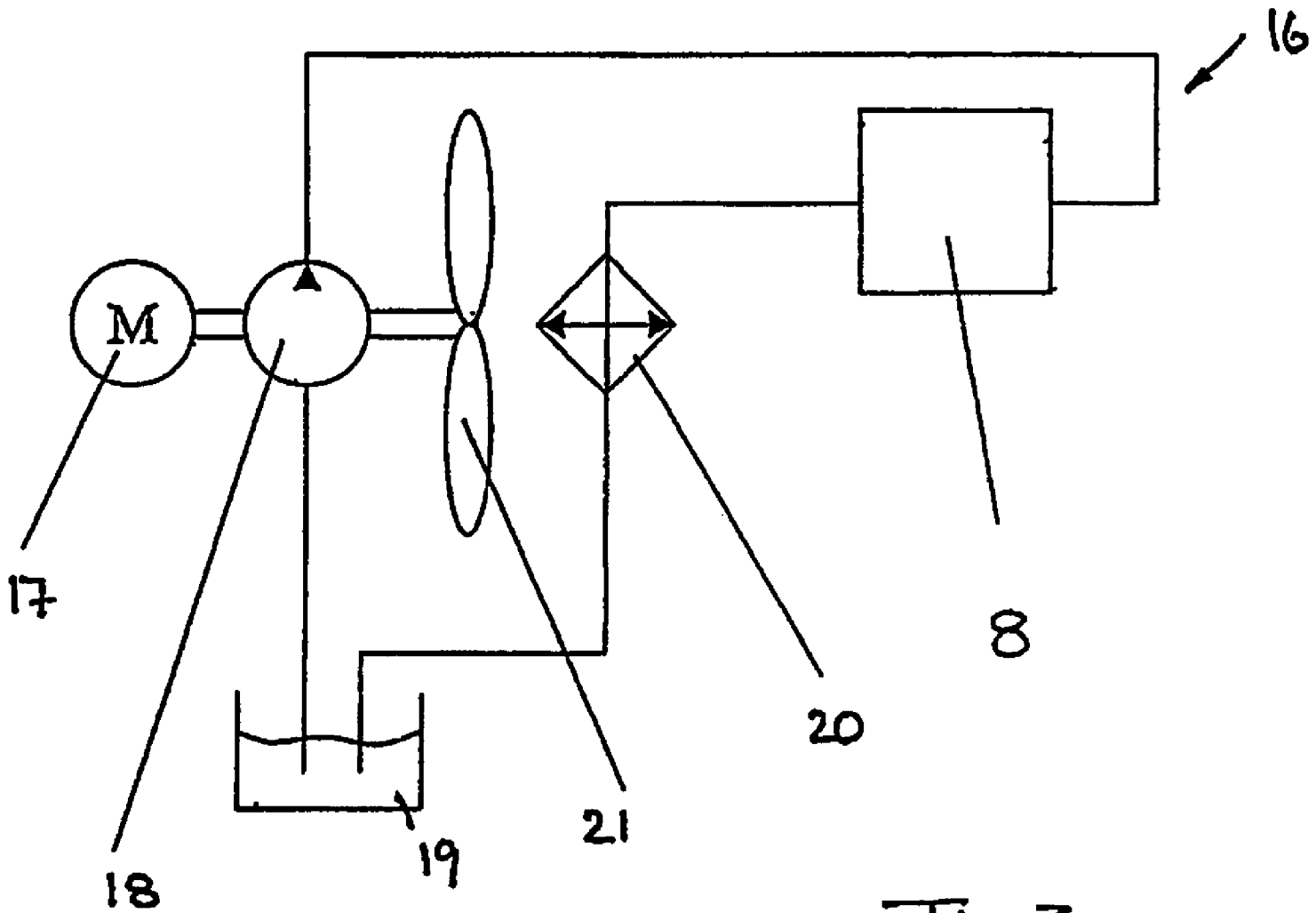
FIG. 3: a schematic representation of the liquid cooling circuit for the cooling of the electronics.

Provision can in particular also be made in a further development of the invention that the cooling circuits are made at least partially separately from one another. In a further development of the invention, respective completely separate cooling circuits can be provided as shown in FIG. 3, i.e. the motor cooling circuit 14, the transmission cooling circuit 11 and the electronics cooling circuit 16 can each be made separately as shown in FIG. 3. The embodiment shown in FIG. 3 comprises a coolant pump 18 which is driven by a motor 17, which circulates the coolant from a tank 19 through the component to be cooled such as the frequency inverter 8 and leads it on the way back to the tank 19 through a heat exchanger 20 with which a fan 21 likewise driven by the motor 17 can advantageously be associated.

Figure 4:
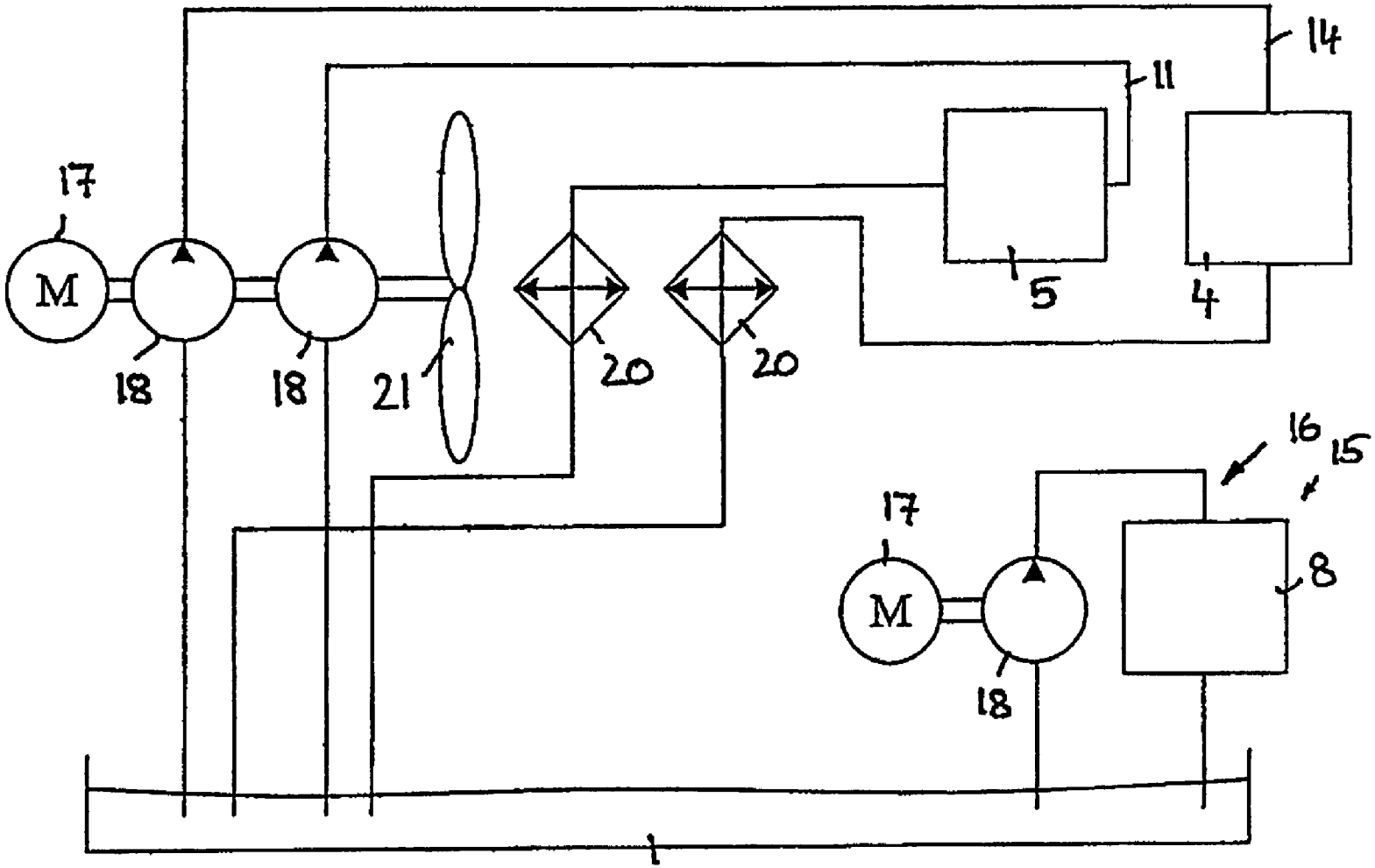
FIG. 4: a schematic representation of the connection of the cooling circuits for the electronics, the motor and the transmission of the hoisting winch of FIG. 1.

As FIG. 4 shows, the coolant circuits 11, 14 and 16 can utilize a partly combined drive of their coolant pumps and a common coolant tank 19. Specifically, in the embodiment shown in FIG. 4, the coolant pumps 18 of the transmission cooling circuit 11 and of the motor cooling circuit 14 are driven by a common motor 17 which also drives a common fan 21 which cools the heat exchangers 20 of the transmission cooling circuit 11 and of the motor cooling circuit 14. In contrast, the coolant pump 18 of the electronics cooling circuit 16 is driven by a separate motor 17 to be able to carry out the cooling of the electronics independently of the cooling of the motor and of the transmission. Optionally, namely, the cooling of the motor and of the transmission can be switched off, while a cooling of the electronics is to be maintained, whereby an advantage is achieved with respect to the total energy balance. As FIG. 4 shows, a heat exchanger can optionally also be omitted in the electronics cooling circuit 16. Since the cooling liquid is taken out of the common tank 19 and is fed back, a separate heat exchanger is optionally not necessary.

Figure 5:
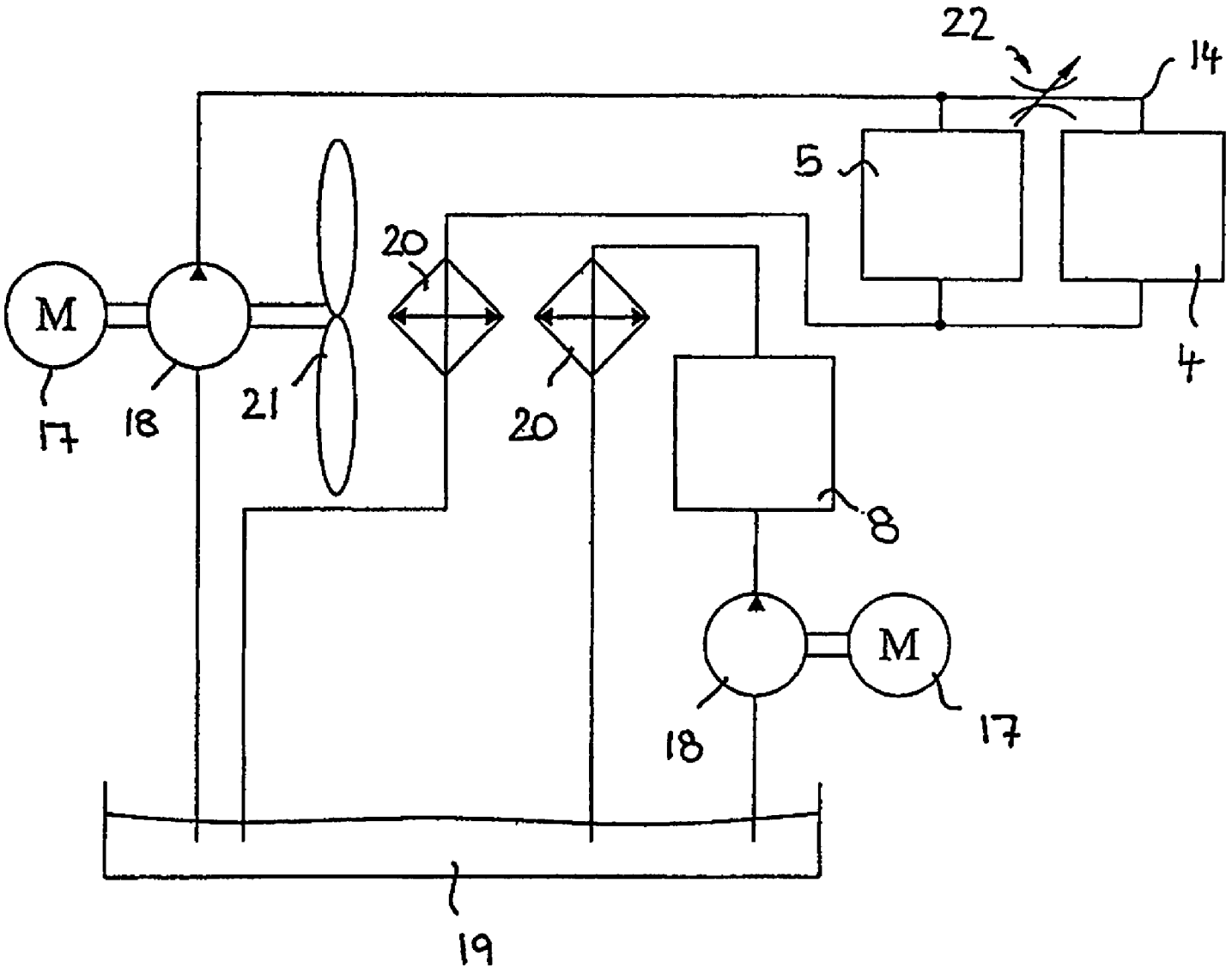
FIG. 5: a schematic representation of the arrangement of the cooling circuits for the electronics, the motor and the transmission in accordance with an alternative advantageous embodiment of the invention in accordance with which the cooling circuits for the motor and the transmission are combined.

As FIG. 5 shows, the cooling circuits themselves can also partly be combined. The motor cooling circuit 14 and the transmission cooling circuit 11 can in particular be combined, with parallel connection of the transmission cooling circuit 11 with the motor cooling circuit 14 being provided in FIG. 5. The quantity of the coolant quantity flowing through the parallel circuit branches can be changed via a flow control means 22, for example in the form of a control valve.

The electronics cooling circuit 16 is, in contrast, also advantageously made separately in the embodiment in accordance with FIG. 5, with in this embodiment a heat exchanger 20 also being provided in the electronics cooling circuit 16 which can be acted on by a common fan 21 together with the heat exchanger 20 of the combined motor cooling circuit and transmission cooling circuit.

As FIG. 1 shows, the power and/or control electronics 7 can be arranged at an end-face end of the inner space of the hoisting drum 2, with the hoisting drum 2 advantageously being able to have an end-face access opening 23 through which the electronics 7 are also accessible and replaceable and/or serviceable with an installed winch. The named access opening 23 can in this respect extend through the spatially fixed winch bearing support at which the hoisting drum 2 is rotatably journaled, cf. FIG. 1. Provision can be made in this respect that a terminal box 24 is positioned on the outer side of the hoisting drum, whereas the actual electronic components of the electronics 7 are received in the hoisting drum interior.

Figure 2:
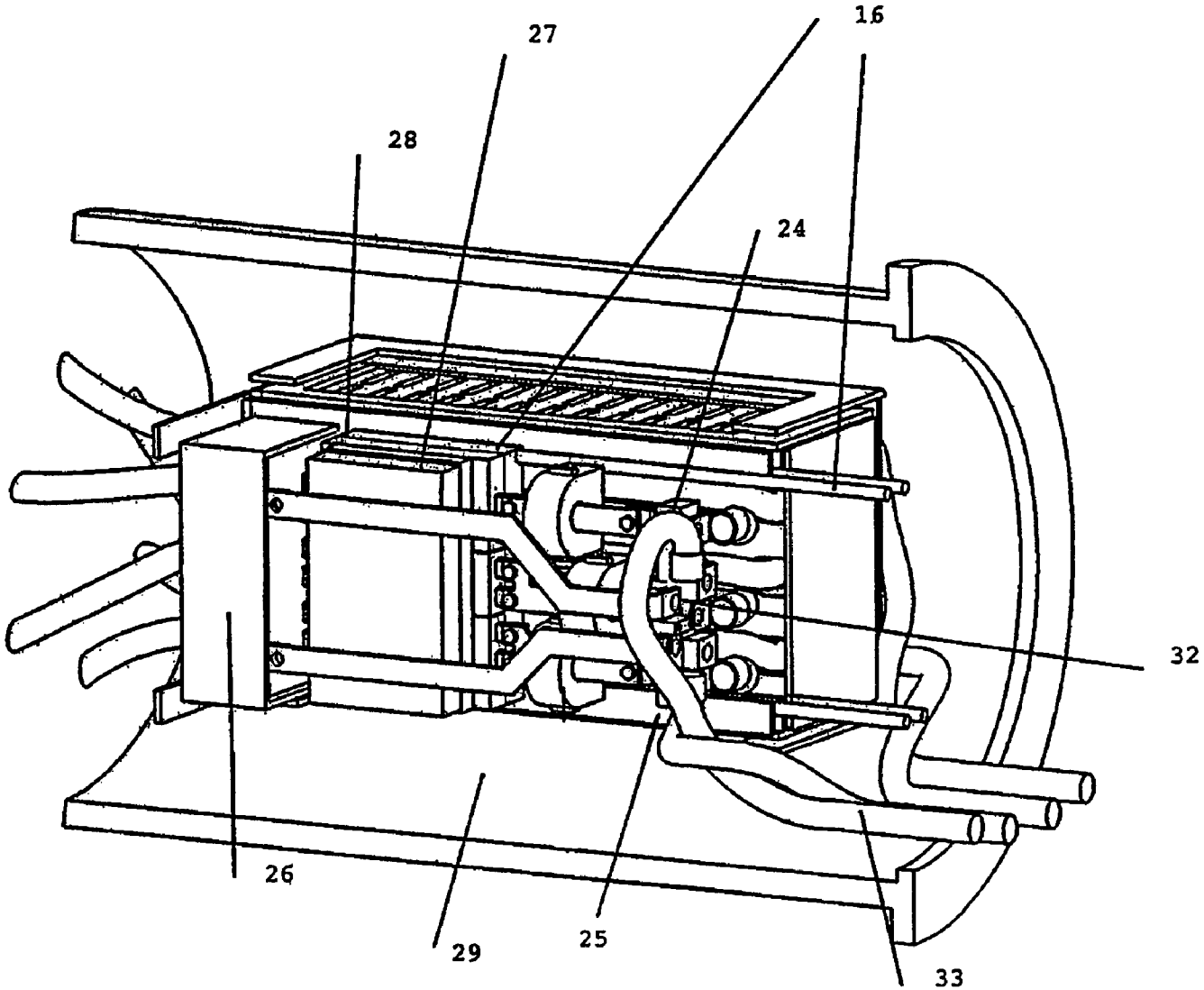
FIG. 2: a section-wise perspective view of the inverter and its components in the interior space of the hoisting drum.

FIG. 2 shows a possible embodiment of the frequency inverter arrangement in the interior of the hoisting drum 2. In the embodiment drawn in FIG. 2, the frequency inverter 8 includes a junction plate 25 on which all the required electrical connections are present. The junction plate 25 is in this respect arranged such that there is good accessibility which allows the frequency inverter 8 or components thereof to be replaced. Intermediate circuit capacitors 26 are equally installed in the frequency inverter 8. The control part 27 and the power modules 28 are integrated in compact form as the heart of the frequency inverter 8. The power transistors are liquid cooled via the electronics cooling circuit 16. The motor current can be measured via sensors 29.

The frequency inverter 8 is advantageously made in modular form and includes a plurality of inverter modules. There is a corresponding winding part in the electric motor 4 for each inverter module or partial inverter so that the motor winding can be connected more simply and can be made in a more space saving manner. The power requirements of the winch and of the drive components of motor and inverter can be adapted to one another by the modular design of the frequency inverter 8.

The frequency inverter 8 is connected to the electric motor 4 via short motor feed lines 31. The frequency inverter 8 can be connected to the power supply in accordance with FIG. 2 via an electrical connection 32 made in screwable form and via a two-core line 33 connected thereto.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

What is claimed is:

1. A winch for elevating at a plant, comprising:

a hoisting drum;

an electric motor for driving the hoisting drum, which is received in an interior of the hoisting drum;

at least one of power electronics and control electronics for the electric motor, including at least one of a frequency inverter and a frequency converter, the at least one of the power electronics and the control electronics for the electric motor being received at least partly in the interior of the hoisting drum, and the frequency inverter being substantially fully received in the interior of the hoisting drum; and an electronics cooling device for cooling of the at least one of the power electronics and the control electronics in the interior of the hoisting drum, with the electronics cooling device being configured for liquid cooling of the frequency inverter.

2. The winch in accordance with claim 1, wherein the electronics cooling device includes a liquid cooling circuit for the cooling of the frequency converter.

3. The winch in accordance with claim 2, wherein the liquid cooling circuit of the electronics cooling device includes a cooling liquid on a water base.

4. The winch in accordance with claim 3, wherein the water base is water or a water-glycol mixture.

5. The winch in accordance with claim 1, wherein the electronics cooling device includes a liquid cooling circuit for the cooling of the frequency inverter, the liquid cooling circuit including at least one of a cooling jacket and a plurality of cooling pipe coils at or in the frequency inverter.

6. The winch in accordance with claim 1, further comprising an electric motor cooling device that includes at least one liquid cooler.

7. The winch in accordance with claim 6, wherein the electronics cooling device includes a liquid cooling circuit, and the liquid cooler associated with the electric motor cooling device is a liquid cooling circuit configured separately from the liquid cooling circuit of the electronics cooling device.

8. The winch in accordance with claim 7, wherein the liquid cooling circuit of the electric motor cooling device and the liquid cooling circuit of the electronics cooling device include separate cooling fluid conveying devices.

9. The winch in accordance with claim 7, wherein the liquid cooling circuit of the electronics cooling device is connected in series or in parallel to the liquid cooling circuit of the electric motor cooling device.

10. The winch in accordance with claim 1, further comprising a transmission arranged in the interior of the hoisting drum, and a transmission cooling device that includes at least one liquid cooling circuit.

11. The winch in accordance with claim 10, wherein the liquid cooling circuit of the transmission cooling device is configured separately from the liquid cooling circuit of the electronics cooling device.

12. The winch in accordance with claim 10, wherein the liquid cooling circuit of the transmission cooling device is combined with the liquid cooling circuit of the electric motor cooling device.

13. The winch in accordance with claim 12, wherein the liquid cooling circuit of the transmission cooling device is connected in series or in parallel with the liquid cooling circuit of the electric motor cooling device.

14. The winch in accordance with claim 1, wherein the hoisting drum includes an end-face access opening through which the frequency inverter is accessible.

15. The winch in accordance with claim 14, further comprising a second winch, and wherein the frequency inverter is replaceable with the second winch.

16. The winch in accordance with claim 1, wherein the frequency inverter is arranged spaced apart from the electric motor at an end face end of the interior of the hoisting drum.

17. The winch in accordance with claim 16, further comprising at least one of a speed sensor and a rotary encoder received in the hoisting drum between the frequency inverter and the electric motor.

18. The winch in accordance with claim 1, wherein the frequency inverter is installed at an end face of the electric motor.

19. The winch in accordance with claim 1, wherein the frequency inverter is configured in modular form and includes a plurality of partial inverters each of which is associated with a winding part of the electric motor.

20. The winch in accordance with claim 1, wherein the winch is associated with at least one of a tower crane, a mobile crane, a harbor crane, and a cable-operated excavator.

21. A hoisting winch comprising:

a hoisting drum;

an electric motor, housed in an interior of the hoisting drum, to drive the hoisting drum;

at least one of power electronics and control electronics for the electric motor, including at least one of a frequency inverter and a frequency converter, the at least one of the power electronics and the control electronics for the electric motor being at least partially housed in the interior of the hoisting drum, and the frequency inverter being substantially fully housed in the interior of the hoisting drum; and an electronics cooling device configured as a liquid cooling circuit to cool the at least one of the power electronics and the control electronics.

22. The hoisting winch according to claim 21, further comprising an electric motor cooling device configured as a liquid cooling circuit, wherein the liquid cooling circuit of the electronics cooling device is (i) separate from, or (ii) connected in series or in parallel with, the liquid cooling circuit of the electric motor cooling device.

23. The hoisting winch according to claim 22, further comprising a transmission arranged in the interior of the hoisting drum, and a transmission cooling device configured as a liquid cooling circuit.

24. The hoisting winch according to claim 23, wherein the liquid cooling circuit of the electronics cooling device, the liquid cooling circuit of the electric motor cooling device, and the liquid cooling circuit of the transmission are connected to each other in series with a common pump provided for circulation of a liquid coolant.

* * * * *